US007137784B2

(12) United States Patent
Hall et al.

(10) Patent No.: US 7,137,784 B2
(45) Date of Patent: Nov. 21, 2006

(54) THERMALLY LOADED COMPONENT

(75) Inventors: Kenneth Hall, Gainsville, GA (US); Sacha Parneix, Mulhouse (FR); Remigi Tschuor, Zürich (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 10/864,532

(22) Filed: Jun. 10, 2004

(65) Prior Publication Data

US 2005/0042096 A1 Feb. 24, 2005

Related U.S. Application Data

(63) Continuation of application No. PCT/CH02/00661, filed on Dec. 4, 2002.

(30) Foreign Application Priority Data

Dec. 10, 2001 (CH) ..... 2251/01

(51) Int. Cl.
*F01D 5/18* (2006.01)

(52) U.S. Cl. ..... 416/97 R; 29/527.6; 29/889.721

(58) Field of Classification Search ..... 416/96 R, 416/97 R; 415/115; 29/527.6, 889.2, 889.721
See application file for complete search history.

(56) References Cited

U.S. PATENT DOCUMENTS

| | | | | |
|---|---|---|---|---|
| 3,171,631 A | | 3/1965 | Aspinwall | 253/39.1 |
| 3,804,551 A | | 4/1974 | Moore | 416/97 |
| 4,278,400 A | * | 7/1981 | Yamarik et al. | 416/97 R |
| 4,474,532 A | * | 10/1984 | Pazder | 416/97 R |
| 4,604,031 A | * | 8/1986 | Moss et al. | 416/97 R |
| 4,775,296 A | * | 10/1988 | Schwarzmann et al. | 416/97 R |
| 4,992,026 A | | 2/1991 | Ohtomo et al. | 416/97 R |
| 5,073,086 A | | 12/1991 | Cooper | 416/96 R |
| 5,232,343 A | | 8/1993 | Butts | 416/97 R |
| 5,403,159 A | | 4/1995 | Green et al. | 416/97 R |
| 5,462,405 A | | 10/1995 | Hoff et al. | 416/97 R |
| 5,498,126 A | | 3/1996 | Pighetti et al. | 415/115 |
| 5,599,166 A | | 2/1997 | Deptowicz et al. | 416/97 R |
| 5,695,321 A | | 12/1997 | Kercher | 416/97 R |
| 5,902,093 A | | 5/1999 | Liotta et al. | 416/97 R |
| 5,931,638 A | | 8/1999 | Krause et al. | 416/97 R |
| 6,183,194 B1 | * | 2/2001 | Cunha et al. | 415/115 |
| 6,220,817 B1 | | 4/2001 | Durgin et al. | 416/97 R |
| 6,254,347 B1 | * | 7/2001 | Shaw et al. | 416/97 R |

(Continued)

FOREIGN PATENT DOCUMENTS

DE 23 36 952 12/1982

(Continued)

OTHER PUBLICATIONS

Robert D. Thulin et al., Energy Efficient Engine High Pressure Turbine Detailed Design Report, NASA CR-165608, 1982, generally and p. 38-42.

(Continued)

*Primary Examiner*—Edward K. Look
*Assistant Examiner*—Nathan White
(74) *Attorney, Agent, or Firm*—Steptoe & Johnson LLP

(57) ABSTRACT

A thermally loaded component has at least one cooling passage for the flow of a cooling fluid passing through it. In the region of a bend, at least one diverter device for the integral capturing of the flow of the cooling fluid is provided within the cooling passage. The diverter device comprises, over the height of the cooling passage, two diverter parts which are spaced apart from one another. The diverter maybe cast with a notch therein so that during cooling, the diverter breaks into separated portions proximate the notch.

29 Claims, 2 Drawing Sheets

U.S. PATENT DOCUMENTS

| | | | | |
|---|---|---|---|---|
| 6,257,831 | B1 * | 7/2001 | Papple et al. | 416/97 R |
| 6,347,923 | B1 | 2/2002 | Semmler et al. | 416/97 R |
| 6,595,750 | B1 * | 7/2003 | Parneix et al. | 416/97 R |
| 2002/0176776 | A1 | 11/2002 | Parneix et al. | 416/97 R |

FOREIGN PATENT DOCUMENTS

| | | | |
|---|---|---|---|
| DE | 198 60 788 | A1 | 7/2000 |
| EP | 0 241 180 | | 10/1987 |
| EP | 0 475 658 | | 3/1992 |
| EP | 0 672 821 | A1 | 9/1995 |
| EP | 0 816 636 | A1 | 1/1998 |
| EP | 1 223 308 | A2 | 7/2002 |
| GB | 1188401 | | 4/1970 |
| GB | 1 303 034 | | 1/1973 |
| GB | 1 551 678 | | 8/1979 |
| GB | 2 165 315 | | 4/1986 |
| GB | 2 165 315 | A | 4/1986 |

OTHER PUBLICATIONS

US 6,120,250, 09/2000, Durgin et al. (withdrawn)

* cited by examiner

THERMALLY LOADED COMPONENT

CROSS-REFERENCE TO RELATED APPLICATIONS

This application is a continuation of the U.S. National Stage designation of co-pending International Patent Application PCT/CH02/00661 filed Dec. 4, 2002, the entire content of which is expressly incorporated herein by reference thereto.

FIELD OF THE INVENTION

The invention is related to a thermally loaded component.

BACKGROUND OF THE INVENTION

An increase in the efficiency of a thermal power machine, e.g. a gas turbine, is directly dependent on an increase in the working temperature of the thermally loaded components and therefore, in the case of a gas turbine, on the combustion gas temperature of the combustion chamber and the turbine which follows it. Despite improvements in materials which are able to withstand high temperatures, cooling technology also needs to be improved in order to keep the materials temperature within a safe range when thermally loaded components of this type are in operation. Cooling passages are used for this purpose and have to be fed with cooling fluid, for example from the compressor. It is attempted in this context to achieve the maximum possible cooling effect combined with the minimum possible losses in power of the overall system. For this purpose, specific improved heat-transfer techniques, such as for example fins in the cooling passages, are used.

GB 2 165 315 has disclosed blades or vanes in which cooling fluid is passed from the trailing-edge region of the blade or vane to the leading-edge region via cooling passages formed by partition walls and is then blown out via openings in the head of the blade or vane. To sufficiently cool the trailing-edge region of the blade or vane, air is blown out of the trailing edge of the blade or vane. Diverter blades are provided in order to divert the cooling fluid into the cooling passages.

In general terms, cooling passages which in many instances run substantially parallel and which are connected via diverter passages are used in thermally loaded components, e.g. blades or vanes of turbines. These diverter passages are configured in such a way that the pressure loss involved in the diversion is minimal and the heat transfer is as homogeneous as possible, in order to avoid local hot zones. To achieve this, in many cases diverter blades are arranged in the region of the diverter passages. However, these diverter blades are very fragile and are difficult to produce by casting, even in the case of large components, such as for example large blades or vanes of stationary gas turbines. By way of example, during cooling of the casting following the casting operation, stresses may form in the casting, since the inner parts, which are of relatively small dimensions, and the outer parts have different cooling rates. In some cases, these stresses may cause cracks to occur in the inner structures, with the result that the casting cannot be used. If the defects are not noticed, the casting may break in use and may then, for example in the case of blades or vanes, cause damage to further blades or vanes and the turbine.

Cooling of turbine blades is known for example from U.S. Pat. No. 3,171,631 or from U.S. Pat. No. 5,232,343.

SUMMARY OF THE INVENTION

The invention is related to a thermally loaded component with at least one cooling passage of the type described in the introduction, and avoiding problems with previously known means for diverting the cooling fluid yet at the same time allowing efficient cooling to be achieved.

The invention is therefore related to a diverter device that comprises two diverter parts that are spaced apart from one another over the height of the cooling passage.

Advantageously, the configuration of the diverter device according to the invention means that the functioning of the diverter device is not impaired compared to previously known diverter blades. The primary function of the diverter device, that of preventing pressure losses and avoiding separation of the cooling fluid stream downstream of the diverter passage, continues to be guaranteed.

Dividing the diverter device into two diverter parts that are spaced apart from one another avoids stresses and cracks that have been detected in blades and vanes that have been disclosed hitherto. Furthermore, the service life of the blades or vanes has been improved with regard to thermomechanical fatigue (TMF).

It is particularly expedient if the diverter parts according to the invention are arranged in cooling passages of blades or vanes of thermal power machines. The diverter maybe cast with a notch therein so that during cooling, the diverter breaks into separated portions proximate the notch.

BRIEF DESCRIPTION OF THE DRAWINGS

The text which follows provides a more detailed explanation of exemplary embodiments of the invention on the basis of the drawings. All the features that are not essential to gaining a direct understanding of the invention have been omitted. Identical components are provided with identical reference numerals throughout the various figures. The direction of flow of the media is indicated by arrows. In the drawings.

Only the components that are essential to gaining an understanding of the invention are shown.

DETAILED DESCRIPTION OF THE PREFERRED EMBODIMENTS

Figure 1:
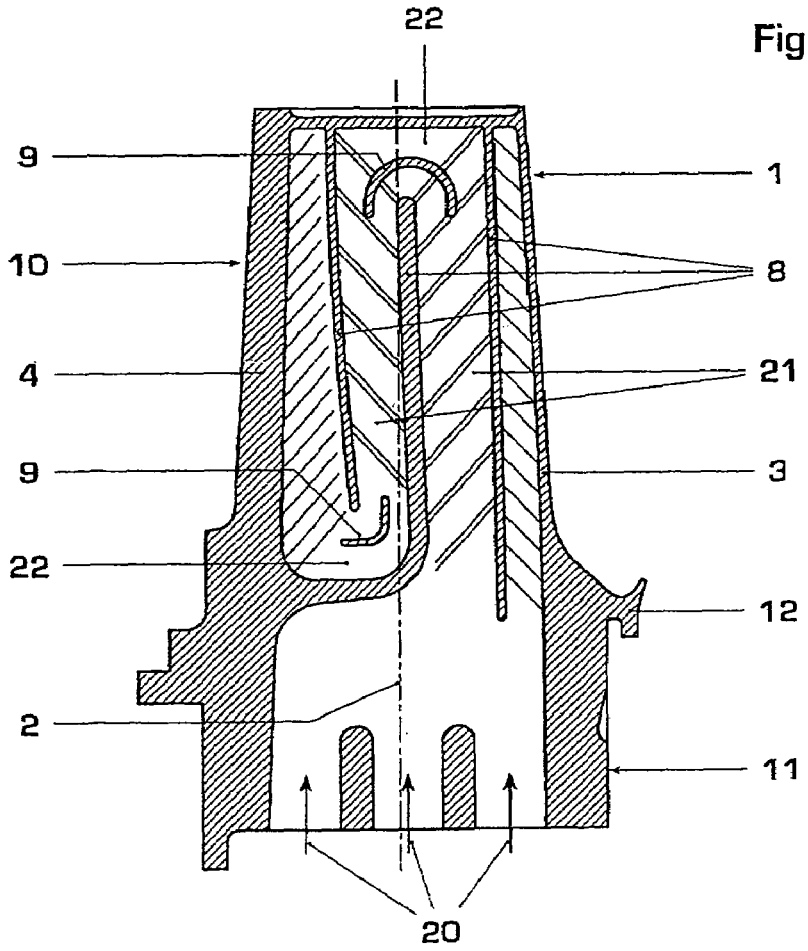
FIG. 1 shows a partial longitudinal section through a blade or vane of a turbine.

FIG. 1 shows a blade or vane 10 of a turbomachine, comprising a main blade or vane part 1 and a blade or vane root 11, by means of which the blade or vane 10 can be mounted on a rotor or stator (not shown). A platform 12, which shields the blade root and therefore the rotor or stator from the fluids flowing around the main blade or vane part, is usually arranged between the main blade or vane part 1 and the blade or vane root 11. The main blade or vane part 1 has a leading-edge region 3, a trailing-edge region 4, a suction-side wall 5 and a pressure-side wall 6 (cf. FIG. 3*a*), with the suction-side wall and the pressure-side wall being connected to one another in the region of the leading edge 3 and the trailing edge 4, so that a cavity 2 is formed. The leading-edge region 3 is in each case the region which is acted on first of all by the fluids flowing around the main blade or vane part 1. The cavity 2 runs substantially in the radial direction through the blade or vane 10 and serves as a cooling-fluid duct for a cooling fluid 20.

To improve the cooling of the blade or vane, substantially radially running partitions 8 are arranged in the cavity 2 so as to produce cooling passages 21. These cooling passages 21 are connected by diverter passages 22, which are configured in such a way that the pressure loss during diversion is minimal and the heat transfer is as homogeneous as possible, in order to avoid local hot zones. To achieve this integral capturing of the flow of cooling fluid, additional diverter devices, such as for example diverter blades 9, are arranged in the region of the diverter passages 22.

Figure 2A:
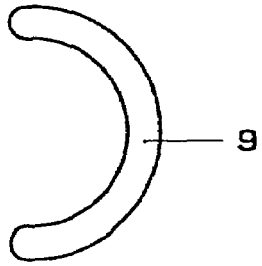
FIGS. 2*a*, 2*b* and 2*c* show various embodiments of a diverter device.
Figure 2B:
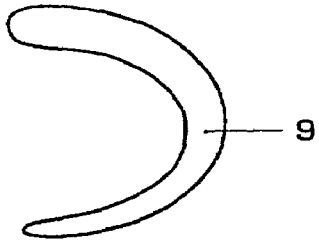
Figure 2C:
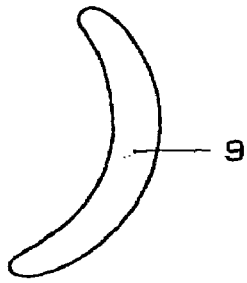

These diverter blades 9, as shown in FIGS. 2*a*, 2*b* and 2*c*, may be of any desired configuration, e.g. with regard to thickness along the blade, radius of curvature, etc., and must in each case be matched to the conditions in the diverter passage 22.

Figure 3A:
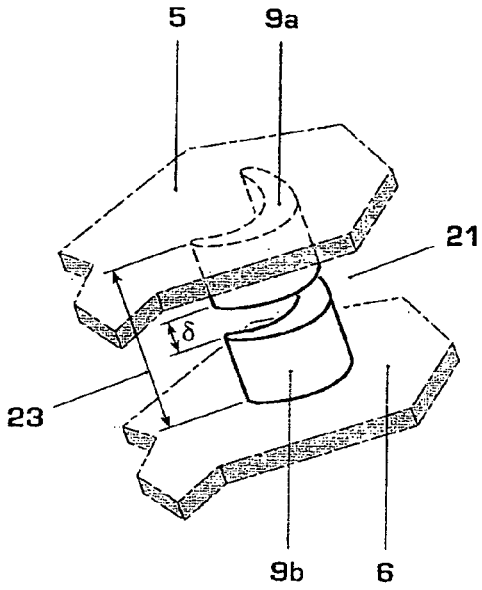
FIGS. 3*a* and 3*b* show a diverter device according to the invention.
Figure 3B:
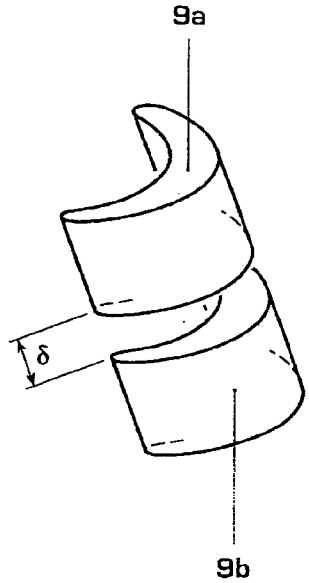
Figure 4:
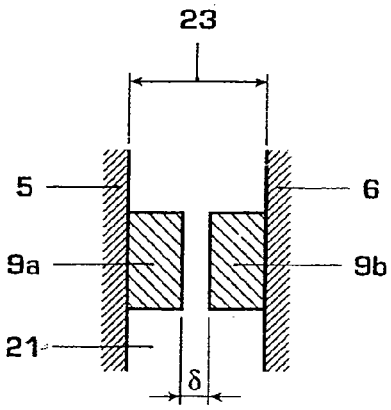
FIG. 4 shows a cross-section through a diverter device according to the invention.

FIGS. 3*a*, 3*b* and 4 show the diverter blade according to the invention, comprising a first diverter part 9*a* on the suction side and a second diverter part 9*b* located opposite the first diverter part 9*a* on the pressure side of the blade or vane. The diverter parts 9*a* and 9*b* are at a distance 6 from one another which may amount to up to 30% of the height 23 of the cooling passage 21 at the location of the diverter parts. The configuration of the diverter parts 9*a* and 9*b* in accordance with the invention has no adverse effect on the functioning of the diverter device compared to diverter blades which have been disclosed hitherto. The primary function of the diverter blade is to prevent pressure losses and to avoid separation of the cooling fluid stream 20 downstream of the diverter passage 22.

Furthermore, tests carried out on blades or vanes according to the invention have established that dividing the previously known diverter devices into two diverter parts prevents stresses and cracks that have been detected in blades that have been disclosed hitherto. Furthermore, it has been found that the service life of the blades with regard to thermomechanical fatigue (TMF) was improved.

The diverter parts may be of any desired configuration, as shown in FIGS. 2*a*, 2*b* and 2*c* and described above in connection with the diverter blade. Furthermore, the configuration of the distance δ between the two diverter parts in the direction of flow of the cooling fluid is variable and the configuration arbitrary, although it must be ensured that the function of the diverter parts, namely that of preventing pressure losses and avoiding separation of the cooling fluid stream 20 downstream of the diverter passage 22, is maintained.

Figure 5:
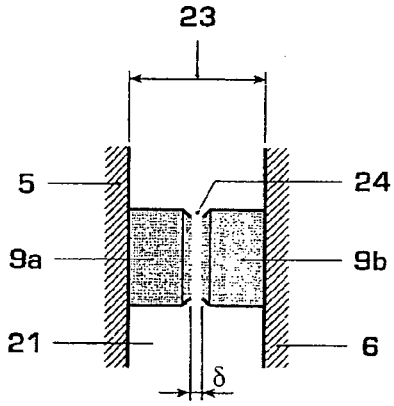
FIG. 5 shows a cross-section through a further diverter device according to the invention.

FIG. 5 shows a further configuration according to the invention of two diverter parts 9*a* and 9*b*. In this case, the distance δ was obtained by arranging a weak point in the diverter blade by means of a narrowing or notch 24 being present in the casting mold. This notch 24 causes the diverter blade to break into two parts during the cooling and resulting shrinkage which occur after the casting process, thereby producing the two diverter parts 9*a* and 9*b* with the distance δ between them. The configuration of the notch 24 makes it possible to adjust the distance δ and its shape.

Of course, the invention is not restricted to the exemplary embodiment which has been shown and described. Diverter parts of this type may in general terms be arranged in bends in cooling passages of thermally loaded components in order to avoid the problems described above.

LIST OF REFERENCE NUMERALS

1 Main blade or vane part
2 Cavity
3 Leading-edge region
4 Trailing-edge region
5 Suction-side wall
6 Pressure-side wall
8 Partition
9 Diverter device/diverter blade
9*a* First diverter part, suction side
9*b* Second diverter part, pressure side
10 Blade or vane
11 Blade or vane root
12 Platform
20 Cooling fluid
21 Cooling passage
22 Diverter passage
23 Height of cooling passage
24 Notch
δ Distance

What is claimed is:

1. A thermally loaded component comprising:

a cooling passage for directing flow of a cooling fluid passing therein in a first direction, the cooling passage having a height defined between a suction-side wall and a pressure-side wall proximate the diverter device;

a diverter device disposed within the cooling passage for directing flow of the cooling fluid in a second direction different from the first direction;

wherein the diverter device comprises two portions spaced from one another over the height of the cooling passage.

2. The thermally loaded component of claim 1, wherein the two portions of the diverter device are aligned with respect to each other.

3. The thermally loaded component of claim 1, wherein the two portions of the diverter device are spaced from one another by no more than 30% of the height.

4. The thermally loaded component of claim 1, wherein the portions of the diverter device comprise an arcuate shape.

5. The thermally loaded component of claim 1, wherein the diverter device is cast.

6. The thermally loaded component of claim 5, wherein each of the portions of the diverter device comprises a cross-section that narrows.

7. The thermally loaded component of claim 1, wherein the component is configured and dimensioned for use in a thermal power machine.

8. The thermally loaded component of claim 1, wherein the component is configured and dimensioned as a blade of a thermal power machine.

9. The thermally loaded component of claim 1, wherein the component is configured and dimensioned as a vane of a thermal power machine.

10. The thermally loaded component of claim 1, wherein the component is configured and dimensioned as a blade for use in a gas turbine.

11. The thermally loaded component of claim 1, wherein the component is configured and dimensioned as a vane for use in a gas turbine.

12. The thermally loaded component of claim 1, wherein a first of the two portions of the diverter device is arranged on the suction side of the thermally loaded component and a second of the two portions of the diverter device is arranged on a pressure side of the thermally loaded component.

13. The thermally loaded component of claim 1, wherein space between the two portions of the diverter device is formed by arranging a weak point in the diverter device using a notch in a casting mold for the component.

14. A thermally loaded component comprising:

a cooling passage for directing flow of a cooling fluid passing therein in a first direction;

a diverter disposed within the cooling passage for directing flow of the cooling fluid away from the first direction;

wherein the cooling passage has a height defined between a suction-side wall and a pressure-side wall proximate the diverter;

wherein the diverter comprises opposing portions spaced from one another over the height of the cooling passage; and wherein the thermally loaded component is configured and dimensioned for use in a gas turbine and is selected from the group consisting of a blade and a vane.

15. The thermally loaded component of claim 14, wherein the opposing portions taper toward one another.

16. The thermally loaded component of claim 14, wherein the opposing portions of the diverter are spaced from one another by no more than 30% of the height.

17. The thermally loaded component of claim 14, wherein the opposing portions of the diverter each comprise an arcuate shape.

18. The thermally loaded component of claim 14, wherein the diverter is formed by casting.

19. The thermally loaded component of claim 14, wherein a first of the opposing portions of the diverter is arranged on a suction side of the thermally loaded component and a second of the opposing portions of the diverter is arranged on a pressure side of the thermally loaded component.

20. The thermally loaded component of claim 14, wherein space between the opposing portions of the diverter is formed by arranging a weak point in the diverter using a notch in a casting mold for the component.

21. A thermally loaded component comprising:

a cooling passage for directing flow of a cooling fluid passing therein in a first direction;

a diverter disposed within the cooling passage for directing flow of the cooling fluid away from the first direction;

wherein the diverter comprises opposing portions spaced from one another;

wherein the thermally loaded component is configured and dimensioned for use in a gas turbine and is selected from the group consisting of a blade and a vane; and wherein the opposing portions form a notched region therebetween.

22. A thermally loaded component comprising:

a cavity;

a plurality of partitions disposed in the cavity forming connected cooling passages for directing flow of a cooling fluid; and at least one diverter disposed between the partitions for directing flow of the cooling fluid between the cooling passages;

a suction-side wall and a pressure-side wall disposed proximate the at least one diverter and defining a height;

wherein the diverter comprises opposing portions spaced from one another over the height; and wherein the thermally loaded component is configured and dimensioned for use in a gas turbine and is selected from the group consisting of a blade and a vane.

23. The thermally loaded component of claim 22, wherein the opposing portions of the diverter each comprise an arcuate shape.

24. The thermally loaded component of claim 22, wherein the opposing portions of the diverter are spaced from one another by no more than 30% of the height.

25. The thermally loaded component of claim 22, wherein a first of the opposing portions of the diverter is arranged on a suction side of the thermally loaded component and a second of the opposing portions of the diverter is arranged on a pressure side of the thermally loaded component.

26. The thermally loaded component of claim 22, wherein space between the opposing portions of the diverter is formed by arranging a weak point in the diverter using a notch in a casting mold for the component.

27. A thermally loaded component comprising:

a cavity;

a suction-side wall and a pressure-side wall;

a plurality of partitions disposed in the cavity forming connected cooling passages for directing flow of a cooling fluid; and a plurality of diverters disposed to direct flow of the cooling fluid between the cooling passages;

wherein each of the diverters comprises first and second portions spaced from one another, the first portion abutting the suction-side wall and the second portion abutting the pressure-side wall;

wherein the thermally loaded component is configured and dimensioned for use in a gas turbine and is selected from the group consisting of a blade and a vane.

28. The thermally loaded component of claim 27, wherein the first and second portions form a notched space therebetween.

29. A method of forming a thermally loaded component comprising:

casting partitions to define a cooling passage for directing flow of a cooling fluid passing therein in a first direction, the cooling passage disposed between a suction-side wall and a pressure-side wall;

casting a diverter within the cooling passage for directing flow of the cooling fluid in a second direction different from the first direction, the diverter being cast with a notch therein;

cooling the diverter so that the diverter breaks into separate portions proximate the notch, the separate portions being spaced from each other and opposing each other with a first of the separate portions abutting the suction-side wall and a second of the separate portions abutting the pressure-side wall.

* * * * *